US010141099B2

(12) United States Patent
Jeong

(10) Patent No.: US 10,141,099 B2
(45) Date of Patent: Nov. 27, 2018

(54) ELECTRONIC COMPONENT AND MANUFACTURING METHOD THEREOF

(71) Applicant: SAMSUNG ELECTRO-MECHANICS CO., LTD., Suwon-Si, Gyeonggi-Do (KR)

(72) Inventor: Dong Jin Jeong, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/939,765

(22) Filed: Nov. 12, 2015

(65) Prior Publication Data

US 2016/0217907 A1 Jul. 28, 2016

(30) Foreign Application Priority Data

Jan. 28, 2015 (KR) ..... 10-2015-0013602

(51) Int. Cl.

| | |
|---|---|
| ***H01F 5/00*** | (2006.01) |
| ***H01F 27/28*** | (2006.01) |
| ***H01F 7/06*** | (2006.01) |
| ***H01F 27/29*** | (2006.01) |
| ***H01F 17/00*** | (2006.01) |
| ***H01F 41/04*** | (2006.01) |
| *H01F 17/04* | (2006.01) |

(52) U.S. Cl.

CPC ..... *H01F 27/292* (2013.01); *H01F 17/0013* (2013.01); *H01F 41/042* (2013.01); *H01F 2017/048* (2013.01)

(58) Field of Classification Search

CPC .. H01F 27/2804; H01F 27/255; H01F 27/292; H01F 14/0013; H01F 14/0006; H01F 2017/048; H01F 41/041; H01F 41/0233; H01F 2017/0073

USPC ..... 336/200, 223, 233, 234; 29/602.1, 605, 29/606

See application file for complete search history.

(56) References Cited

U.S. PATENT DOCUMENTS 7,759,776 B2 7/2010 Cheng
2004/0056749 A1* 3/2004 Kahlmann ..... H01L 27/08 336/200

(Continued)

FOREIGN PATENT DOCUMENTS

CN 101046482 A 10/2007
CN 101620916 A 1/2010

(Continued)

OTHER PUBLICATIONS

Chinese Office Action dated May 18, 2017, issued in Chinese Patent Application No. 201510849783.5. (w/ English translation).

(Continued)

*Primary Examiner* — Mangtin Lian

(74) *Attorney, Agent, or Firm* — McDermott Will & Emery LLP

(57) ABSTRACT

An electronic component includes a magnetic body and an internal coil structure embedded in the magnetic body. The internal coil structure includes a first coil pattern part and a second coil pattern part formed on the first coil pattern part. An outermost coil pattern portion of the first coil pattern part is thicker than an inner coil pattern portion thereof.

20 Claims, 4 Drawing Sheets

(56) References Cited

U.S. PATENT DOCUMENTS

| | | | | |
|---|---|---|---|---|
| 2004/0164835 | A1* | 8/2004 | Shoji | H01F 17/0013 336/200 |
| 2007/0235873 | A1* | 10/2007 | Cheng | G01R 1/07378 257/738 |
| 2008/0174397 | A1* | 7/2008 | de Rooij | G01R 33/34 336/200 |
| 2009/0322458 | A1* | 12/2009 | Lee | H01F 17/0006 335/299 |
| 2013/0249662 | A1* | 9/2013 | Tonoyama | H01F 27/255 336/200 |
| 2013/0300529 | A1 | 11/2013 | Chang et al. | |
| 2013/0335186 | A1* | 12/2013 | Chang | H01F 5/003 336/200 |
| 2014/0197917 | A1 | 7/2014 | Naito et al. | |
| 2015/0035640 | A1* | 2/2015 | Wang | H01F 17/0006 336/200 |
| 2015/0123757 | A1 | 5/2015 | Choi | |

FOREIGN PATENT DOCUMENTS

| | | | |
|---|---|---|---|
| CN | 103377811 | A | 10/2013 |
| CN | 103733280 | A | 4/2014 |
| CN | 104282421 | A | 1/2015 |
| EP | 2645385 | A2 | 10/2013 |
| JP | 10-241983 | A | 9/1997 |
| JP | 2001-267166 | A | 9/2001 |
| JP | 2004-319570 | A | 11/2004 |
| JP | 2006-278479 | A | 10/2006 |
| JP | 2010016337 | A | 1/2010 |
| KR | 101474166 | B1 | 12/2014 |

OTHER PUBLICATIONS

Korean Office Action issued in Korean Patent Application No. 10-2015-0013602, dated Jun. 16, 2017.

* cited by examiner

ELECTRONIC COMPONENT AND MANUFACTURING METHOD THEREOF

CROSS-REFERENCE TO RELATED APPLICATION

This application claims benefit of priority to Korean Patent Application No. 10-2015-0013602 filed on Jan. 28, 2015, with the Korean Intellectual Property Office, the disclosure of which is incorporated herein in its entirety by reference.

TECHNICAL FIELD

The present disclosure relates to an electronic component and a manufacturing method thereof.

BACKGROUND

An inductor, an electronic component, is a representative passive element configuring an electronic circuit together with a resistor and a capacitor, to remove noise therefrom.

A thin film inductor is commonly manufactured by forming a coil pattern by plating and then hardening a magnetic powder-resin composite in which a magnetic powder and a resin are mixed with each other to form a magnetic body, and forming external electrodes on outer surfaces of the magnetic body.

In accordance with recent trends for increased complexity, slimness, multifunctionality and the like, in device components, attempts at manufacturing a thin film inductor having a reduced thickness have continued. Therefore, thin film inductors allowing high performance and reliability to be secured therein, even in light of the trend for device component slimness are required.

SUMMARY

An aspect of the present disclosure may provide a slim electronic component having improved electrical properties by controlling a thickness of a first coil pattern part to induce anisotropic plating growth of a second coil pattern part, and a method for effectively manufacturing the electronic component.

According to an aspect of the present disclosure, an electronic component may include a magnetic body and an internal coil structure embedded in the magnetic body. The internal coil structure may include a first coil pattern part and a second coil pattern part formed on the first coil pattern part. An outermost coil pattern portion of the first coil pattern part may be thicker than an inner coil pattern portion thereof.

When a thickness of the outermost coil pattern portion of the first coil pattern part is a and a thickness of the inner coil pattern portion thereof is b, $0\ \mu m<a-b\leq 20\ \mu m$ may be satisfied.

When a thickness of the outermost coil pattern portion of the first coil pattern part is a and a thickness of the inner coil pattern portion thereof is b, $1<a/b\leq 1.8$ may be satisfied.

A difference between a sum of a thickness of the outermost coil pattern portion of the first coil pattern part and a thickness of an outermost coil pattern portion of the second coil pattern part formed thereon and a sum of a thickness of the inner coil pattern portion of the first coil pattern part and a thickness of an inner coil pattern portion of the second coil pattern part formed thereon may be within 20 μm.

The second coil pattern part may be formed by anisotropic plating.

The second coil pattern part may be formed on upper surfaces of the coil pattern portions of the first coil pattern part.

The second coil pattern part may not be formed on at least a portion of side surfaces of the coil pattern portions of the first coil pattern part.

The first and second coil pattern parts may be formed of the same metal.

The magnetic body may contain a magnetic metal powder and a thermosetting resin.

The internal coil structure may include a first internal coil structure disposed on one surface of a support member and a second internal coil structure disposed on the other surface of the support member opposing one surface thereof.

The support member may have a through-hole in a central portion thereof, and the through-hole may be filled with a magnetic material to form a core part.

The electronic component may further include external electrodes disposed on outer surfaces of the magnetic body to be electrically connected to the internal coil structure.

According to another aspect of the present disclosure, a method of manufacturing an electronic component may include forming an internal coil structure on a support member and forming a magnetic body by stacking magnetic sheets to embed the internal coil structure therein. The internal coil structure may include a first coil pattern part formed on the support member and a second coil pattern part formed on the first coil pattern part. An outermost coil pattern portion of the first coil pattern part may be thicker than an inner coil pattern portion thereof.

The method may further include forming external electrodes on outer surfaces of the magnetic body to be electrically connected to the internal coil structure.

The second coil pattern part may be formed by anisotropic plating.

BRIEF DESCRIPTION OF DRAWINGS

The above and other aspects, features and advantages of the present disclosure will be more clearly understood from the following detailed description taken in conjunction with the accompanying drawings.

DETAILED DESCRIPTION

Figure 1:
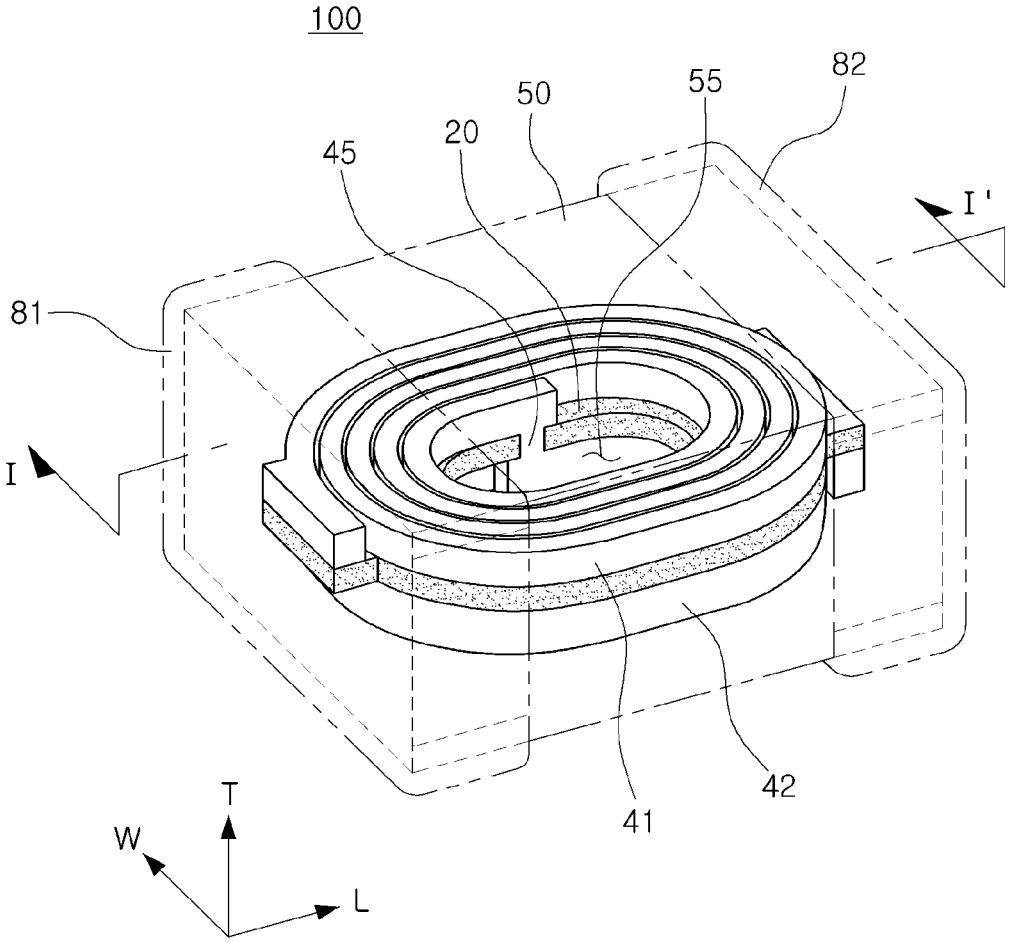
FIG. 1 is a perspective view schematically illustrating an electronic component including internal coil structures according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Electronic Component

Hereinafter, an electronic component, particularly, a thin film inductor, according to an exemplary embodiment, will be described. However, the electronic component according to exemplary embodiments is not necessarily limited thereto.

FIG. 1 is a schematic perspective view illustrating an electronic component including internal coil structures according to an exemplary embodiment in the present disclosure. Referring to FIG. 1, as an example of the electronic component, a thin film inductor used for a power line of a power supply circuit is disclosed.

The electronic component 100 according to an exemplary embodiment may include a magnetic body 50, internal coil structures 41 and 42 embedded in the magnetic body 50, and first and second external electrodes 81 and 82 disposed on outer surfaces of the magnetic body 50 to be electrically connected to the internal coil structures 41 and 42.

In the electronic component 100 according to an exemplary embodiment, a 'length' direction refers to an 'L' direction of FIG. 1, a 'width' direction refers to a 'W' direction of FIG. 1, and a 'thickness' direction refers to a 'T' direction of FIG. 1.

The magnetic body 50 may form the exterior of the electronic component 100, and may be formed by including ferrite or magnetic metal particles in a resin part. However, a material for forming the magnetic body is not specifically limited, as long as the material exhibits magnetic properties.

Specific examples of the ferrite may include Mn—Zn-based ferrite, Ni—Zn-based ferrite, Ni—Zn—Cu-based ferrite, Mn—Mg-based ferrite, Ba-based ferrite, or Li-based ferrite. The magnetic body (50) may have ferrite particles dispersed in a resin such as epoxy or polyimide.

In addition, the magnetic metal particles may include at least one selected from the group consisting of Fe, Si, Cr, Al and Ni. For example, the magnetic metal particles may be a Fe—Si—B—Cr-based amorphous metal, but examples of the magnetic metal particles are not necessarily limited thereto. The magnetic metal particles may have a diameter of about 0.1 μm to 30 μm, and similar to the above-described ferrite, the magnetic body 50 may have the magnetic metal particles dispersed in a thermosetting resin such as epoxy or polyimide.

The first internal coil structure 41 having a coil shape may be disposed on one surface of a support member 20 disposed in the magnetic body 50, and the second internal coil structure 42 having a coil shape may be disposed on the other surface of the support member 20 opposing the one surface of the support member 20. In this case, the first and second internal coil structures 41 and 42 may be electrically connected to each other by a via 45 formed by filling a via hole penetrating through the support member 20 with a conductive material. The first and second internal coil structures 41 and 42 may have a spiral shape.

For example, the support member 20 may be a polypropylene glycol (PPG) substrate, a ferrite substrate or a metallic soft magnetic substrate, and the like. The support member 20 may have a through-hole penetrating through the central portion thereof, and the through-hole may be filled with a magnetic material to form a core part 55. The core part 55 made of the magnetic material may be formed as described above to improve performance of the thin film inductor.

The first and second internal coil structures 41 and 42 and the via 45 may contain a metal having excellent electrical conductivity, and for example, may be formed of silver (Ag), palladium (Pd), aluminum (Al), nickel (Ni), titanium (Ti), gold (Au), copper (Cu), platinum (Pt), alloys thereof, and the like. In this case, the first and second internal coil structures 41 and 42 having a thin film shape may be formed by electroplating, but may be formed by other methods known in the art as long as the first and second internal coil structures having a thin film shape are formed.

Meanwhile, direct current resistance Rdc, one of the main characteristics of the inductor, is decreased as cross-sectional areas of the internal coil structures are increased. In addition, inductance of the inductor is increased as an area of a magnetic body through which magnetic flux passes is increased. Therefore, in order to decrease direct current resistance Rdc and increase inductance, the cross-sectional areas of the internal coil structures need to be increased and the area of the magnetic body needs to be increased.

Increasing widths of coil pattern portions and increasing thicknesses of the coil pattern portions may increase the cross-sectional areas of the internal coil structures. However, when the widths of the coil pattern portions are increased, a possibility of short-circuits occurring between the coil pattern portions may be excessively increased, the number of turns of a coil may be limited, and an area of the magnetic body may be decreased, such that efficiency may be deteriorated and there may be limitations in implementing a product having high inductance.

Accordingly, the internal coil structures having a high aspect ratio (AR) by increasing thicknesses of the coil pattern portions without increasing widths of the coil pattern portions are required. Here, the aspect ratio (AR) of the internal coil structures refers to a value obtained by dividing the thickness of a coil pattern portion by the width of the coil pattern portion. As an increased amount of the thickness of the coil pattern portion is larger than an increased amount of the width of the coil pattern portion, the high aspect ratio (AR) may be implemented.

However, as plating proceeds during electroplating, due to isotropic growth in width and thickness directions, short-circuits may occur between the coil pattern portions, and thus, it may be difficult to implement internal coil structures having a high aspect ratio (AR).

According to an exemplary embodiment, the shape of coil pattern parts of the internal coil structures may be controlled to induce anisotropic plating growth as described below, thereby forming internal coil structures having a high aspect ratio (AR).

Figure 2:
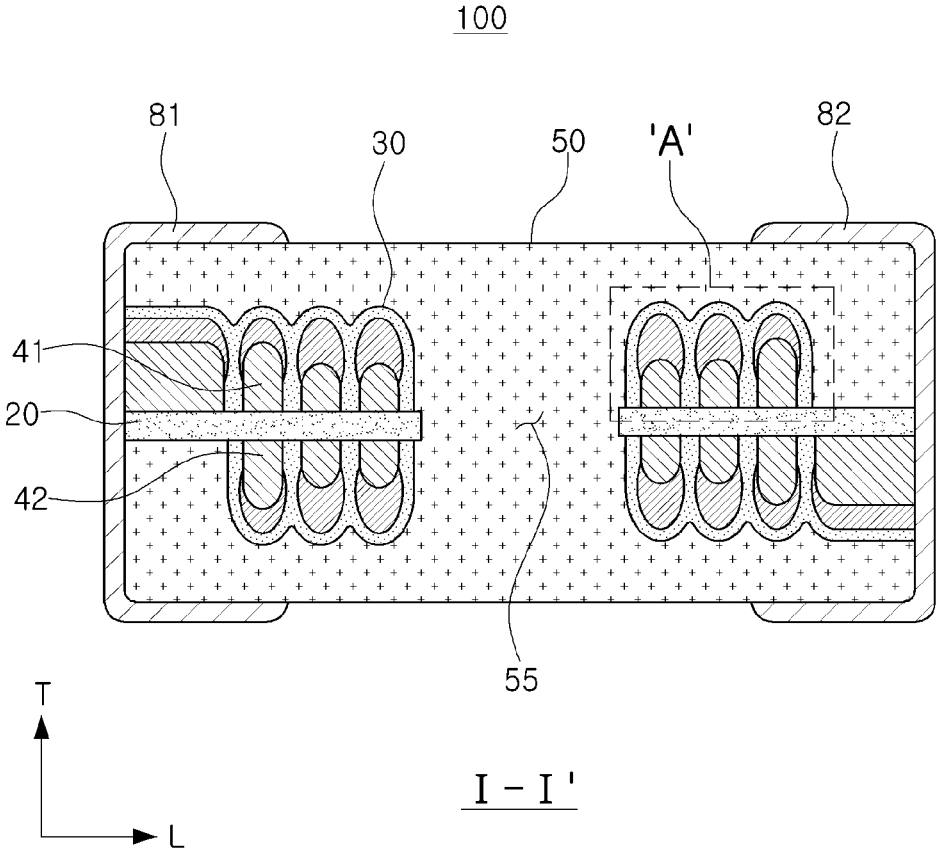
FIG. 2 is a cross-sectional view taken along line I-I' of FIG. 1.
Figure 3:
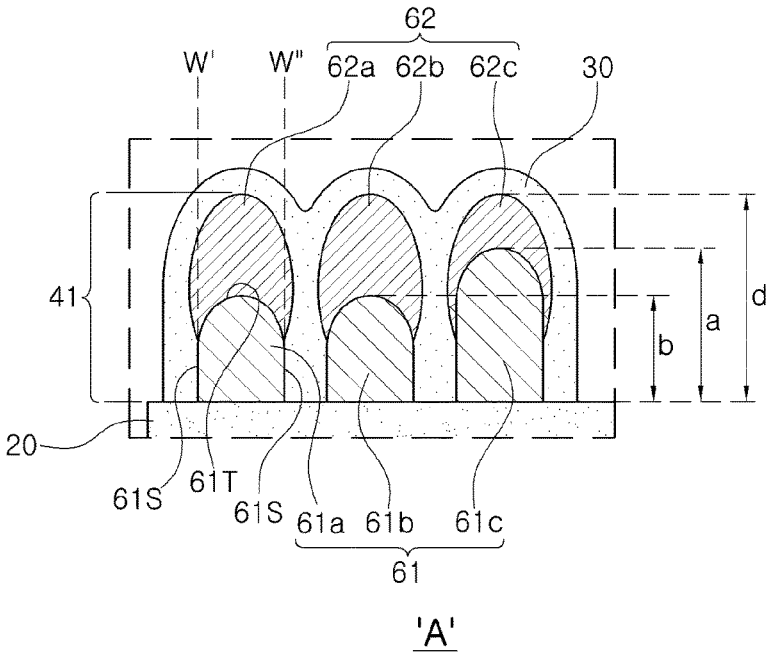
FIG. 3 is an enlarged view schematically illustrating an example of part 'A' of FIG. 2.

FIG. 2 is a cross-sectional view taken along line I-I' of FIG. 1. FIG. 3 is an enlarged view schematically illustrating an example of part 'A' of FIG. 2. Referring to FIGS. 2 and 3, the first and second internal coil structures 41 and 42 may include a first coil pattern part 61 formed on the support member 20, and a second coil pattern part 62 formed on the first coil pattern part 61.

In the first coil pattern part 61 according to an exemplary embodiment, an outermost coil pattern portion 61*c* may be thicker than inner coil pattern portions 61*a* and 61*b*, and in this case, a final thickness d of the internal coil structure (the coil pattern) formed by inducing anisotropic plating growth may be uniform. On the contrary, when the thickness of the outermost coil pattern portion 61*c* of the first coil pattern part 61 is equal to or thinner than that of the inner coil pattern portions 61*a* and 61*b* thereof, the final thickness d of the coil pattern formed by anisotropic plating may be non-uniform, and therefore, short-circuits may occur between the coil pattern portions. Meanwhile, although the inner coil pattern portions 61*a* and 61*b* having the same thicknesses are illustrated in the drawings, the thicknesses of the inner coil pattern portions may not be necessarily equal to each other so long as the inner coil pattern portions 61*a* and 61*b* are thinner than the outermost coil pattern portion 61*c*.

When the thickness of the outermost coil pattern portion 61*c* is a and the thickness of the inner coil pattern portions 61*a* and 61*b* is b, Equation (1) below may be satisfied. When the thickness of the outermost coil pattern portion 61*c* and the thickness of the inner coil pattern portions 61*a* and 61*b* satisfy Equation (1) below, the final thickness d of the coil pattern formed by inducing anisotropic plating growth may be uniform, and as a result, the electronic component may have unexpectedly excellent electrical performance. Meanwhile, when a difference between the thickness of the outermost coil pattern portion 61*c* and the thickness of the inner coil pattern portions 61*a* and 61*b* is greater than 20 μm, short-circuits may occur among the coil pattern portions due to overgrowth of the outermost coil pattern portion 61*c*. Meanwhile, in Equation (1) below, 0 μm<a−b<20 μm may be satisfied, but the range of a−b is not limited thereto:

$$0\ \mu m < a - b \leq 20\ \mu m. \qquad \text{Equation (1)}$$

Similar to the above description, when the thickness of the outermost coil pattern portion 61*c* is a and the thickness of the inner coil pattern portions 61*a* and 61*b* is b, Equation (2) below may be satisfied. Similar to the above description, when the thickness of the outermost coil pattern portion 61*c* and the thickness of the inner coil pattern portions 61*a* and 61*b* satisfy Equation (2) below, the final thickness d of the coil pattern formed by inducing anisotropic plating growth may be uniform, and as a result, the electronic component may have unexpectedly excellent electrical performance. Meanwhile, when a ratio between the thickness of the outermost coil pattern portion 61*c* and the thickness of the inner coil pattern portions 61*a* and 61*b* is greater than 1.2, short-circuits may occur between the coil pattern portions due to overgrowth of the outermost coil pattern portion 61*c*. Meanwhile, in Equation (2) below, 1<a/b<1.8 or 1<a/b<1.2 may be satisfied, but the range of a/b is not limited thereto:

$$1 < a/b \leq 1.8. \qquad \text{Equation (2)}$$

As described above, the final thickness of the internal coil structure (coil pattern) formed by inducing anisotropic plating may be uniform. A difference between the sum of the thickness of the outermost coil pattern portion 61*c* of the first coil pattern part 61 and a thickness of the outermost coil pattern portion 62*c* of the second coil pattern part 62 grown thereon and the sum of the thickness of the inner coil pattern portion 61*a* or 61*b* of the first coil pattern part 61 and a thickness of an inner coil pattern portion 62*a* or 62*b* of the second coil pattern part 62 grown thereon may be within 20 μm. The thickness d of each of the internal coil structures 41 and 42 may be 200 μm to 500 μm, and the thicknesses d of the internal coil structures 41 and 42 may be substantially equal to each other. When the final thickness of the coil pattern is uniform as described above, the electronic component may have excellent electrical performance.

As illustrated in FIG. 3, according to an exemplary embodiment, the second coil pattern part 62 may be formed by anisotropic plating, the coil pattern portions 62*a*, 62*b* and 62*c* of the second coil pattern part 62 may be formed on upper surfaces 61T of the coil pattern portions 61*a*, 61*b* and 61*c* of the first coil pattern part 61, respectively, and side surfaces 61S of the coil pattern portions 61*a*, 61*b*, and 61*c* of the first coil pattern part 61 may not be covered with the second coil pattern part 62.

For example, the upper surfaces 61T of the coil pattern portions 61*a*, 61*b*, and 61*c* of the first coil pattern part 61 refer to surfaces of top portions of the coil pattern portions 61*a*, 61*b*, and 61*c* on the basis of virtual lines W' and W", and the side surfaces 61S of the coil pattern portions 61*a*, 61*b*, and 61*c* of the first coil pattern part 61 refer to surfaces of side portions of the coil pattern portions 61*a*, 61*b*, and 61*c* on the basis of the virtual lines W' and W".

That is, the second coil pattern part 62 may not cover all of the side surfaces 61S of the coil pattern portions 61*a*, 61*b* and 61*c* of the first coil pattern part 61, and accordingly, the second coil pattern part 62 may not be formed on at least a portion of the side surfaces 61S of the coil pattern portions 61*a*, 61*b* and 61*c* of the first coil pattern part 61.

As described above, the coil pattern portions 62*a*, 62*b* and 62*c* of the second coil pattern part 62 may be formed as an anisotropic plating layer which is grown on the upper surfaces 61T of the coil pattern portions 61*a*, 61*b* and 61*c* of the first coil pattern part 61 in the thickness direction, while inhibiting growth in the width direction. As a result, short-circuits occurring between the coil pattern portions may be prevented, and the internal coil structures 41 and 42 having a high aspect ratio (AR) may be formed. In addition, a volume of the core part 55 may be increased while direct current resistance Rdc is decreased, and thus, high inductance may be implemented.

The first and second coil pattern parts 61 and 62 may contain a metal having excellent electrical conductivity. For example, the first and second coil pattern parts 61 and 62 may be formed of silver (Ag), palladium (Pd), aluminum (Al), nickel (Ni), titanium (Ti), gold (Au), copper (Cu), platinum (Pt), or alloys thereof. Meanwhile, the first and second coil pattern parts 61 and 62 may be formed of the same metal. Here, the metal forming the first and second coil pattern parts 61 and 62 may be copper (Cu).

Figure 4:
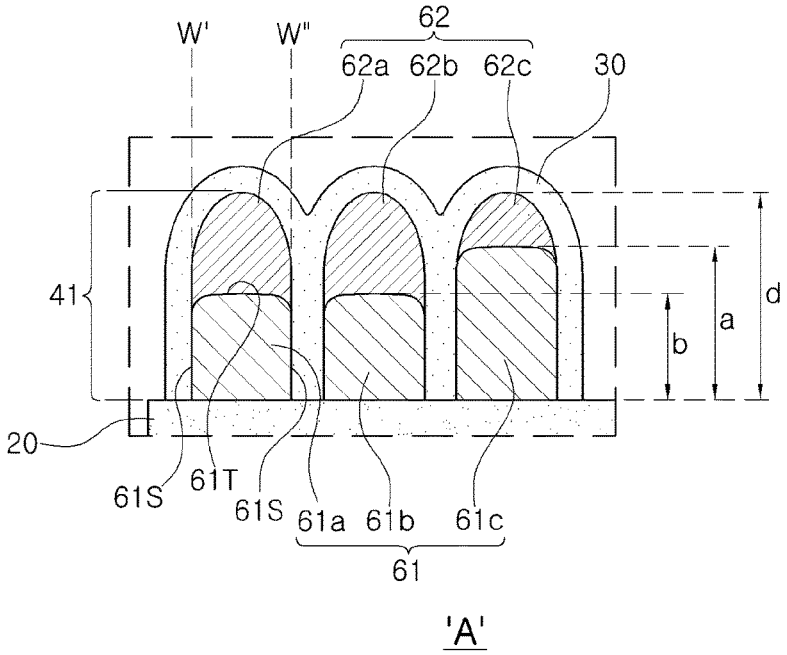
FIG. 4 is an enlarged view schematically illustrating another example of part 'A' of FIG. 2.

FIG. 4 is an enlarged view schematically illustrating another example of part 'A' of FIG. 2.

Referring to FIG. 4, upper surfaces 61T of coil pattern portions 61*a*, 61*b* and 61*c* of a first coil pattern part 61 according to another exemplary embodiment may be flat, and each of the coil pattern portions 61*a*, 61*b* and 61*c* may have a quadrangular cross-section.

Although FIG. 3 illustrates that the upper surfaces 61T of the coil pattern portions 61*a*, 61*b* and 61*c* of the first coil pattern part 61 are convex and FIG. 4 illustrates that the upper surfaces 61T of the coil pattern portions 61*a*, 61*b* and 61*c* of the first coil pattern part 61 are flat, the shapes of the upper surfaces of the coil pattern portions are not necessarily limited thereto. That is, the cross-sectional shapes of the coil pattern portions 61*a*, 61*b* and 61*c* of the first coil pattern part 61 may be modified within a range capable of being conceived of by a person skilled in the art.

The internal coil structures 41 and 42 may be covered with an insulating layer 30 as required. The insulating layer 30 may be formed by a method known in the art such as a screen printing method, a photo resist (PR) exposure and development method, or a spray application method. The internal coil structures 41 and 42 may be covered with the insulating layer 30, and therefore, may not be in direct contact with a magnetic material forming the magnetic body 50.

One end portion of the first internal coil structure 41 formed on one surface of the support member 20 may be exposed to one end surface of the magnetic body 50 in a length (L) direction thereof, and one end portion of the second internal coil structure 42 formed on the other surface of the support member 20 may be exposed to the other end surface of the magnetic body 50 in the length (L) direction thereof.

The first and second external electrodes 81 and 82 may be formed on opposite end surfaces of the magnetic body 50 in the length L direction to be connected to the end portions of the first and second internal coil structures 41 and 42 exposed to opposite end surfaces of the magnetic body 50, respectively.

The first and second external electrodes 81 and 82 may be formed of a metal having excellent electrical conductivity, for example, nickel (Ni), copper (Cu), tin (Sn), silver (Ag), or alloys thereof.

For example, the first and second external electrodes 81 and 82 may include a conductive resin layer and a plating layer formed on the conductive resin layer. The conductive resin layer may include at least one conductive metal selected from the group consisting of copper (Cu), nickel (Ni), and silver (Ag), and a thermosetting resin. The plating layer may include at least one selected from the group consisting of nickel (Ni), copper (Cu), and tin (Sn). For example, a nickel (Ni) layer and a tin (Sn) layer may be sequentially formed as the plating layer.

Method of Manufacturing Electronic Component

Figure 5:
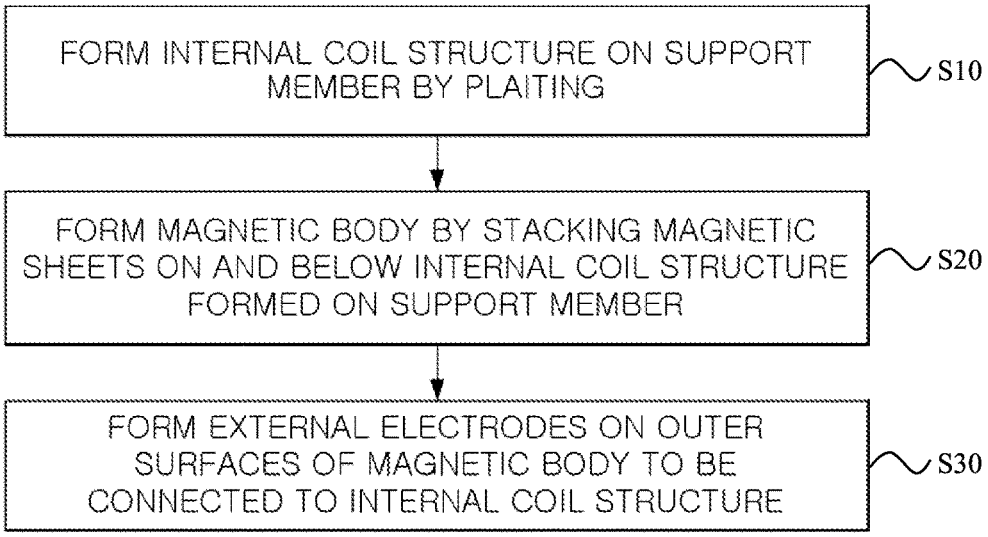
FIG. 5 is a flowchart illustrating a method of manufacturing an electronic component according to an exemplary embodiment in the present disclosure.

FIG. 5 is a flowchart schematically illustrating a method of manufacturing an electronic component according to an exemplary embodiment in the present disclosure. Referring to FIGS. 1 through 4, the method of manufacturing the electronic component is described.

First, the internal coil structures 41 and 42 may be formed on the support member 20 by plating, but the method of forming the internal coil structures 41 and 42 is not necessarily limited thereto.

As described above, the internal coil structures 41 and 42 may include the first coil pattern part 61 formed on the support member, and the second coil pattern part 62 formed on the first coil pattern part 61 (S10).

In the present exemplary embodiment, a thickness a of an outermost coil pattern portion 61*c* of the first coil pattern part 61 may be thicker than a thickness b of inner coil pattern portions 61*a* and 61*b* thereof, such that the second coil pattern part 62 may be formed by anisotropic plating in a subsequent method, and as a result, a final thickness d of the coil pattern may be uniform. In this case, the internal coil structures 41 and 42 may be formed by plating, and the thickness a of the outermost coil pattern 61*c* may be thicker than the thickness b of the inner coil pattern portions 61*a* and 61*b* by controlling a current density, a concentration of a plating solution, a plating rate, and the like.

Meanwhile, as described above, the insulating layer 30 covering the internal coil structures 41 and 42 may be formed to protect the internal coil structures 41 and 42, and the insulating layer 30 may be formed by methods known in the art such as a screen printing method, a photo resist (PR) exposure and development method, or a spray application method.

Next, the magnetic body 50 may be formed by stacking magnetic sheets on and below the internal coil structures 41 and 42 formed on the support member 20, and then compressing and hardening the magnetic sheets (S20). The magnetic sheets may be manufactured by mixing magnetic metal powder and an organic material such as a binder, a solvent, and the like, with each other to prepare slurry, applying the slurry to carrier films to a thickness of several tens of micrometers using a doctor blade method and drying the same.

A central portion of the support member 20 may be removed by performing mechanical drilling, laser drilling, sand blasting, punching, or the like to forma hole for the core part 55, and the hole may be filled with a magnetic material in the stacking, compressing and hardening of the magnetic sheets to form the core part 55.

Next, the first and second external electrodes 81 and 82 may be formed on outer surfaces of the magnetic body 50 to be connected to the internal coil structures 41 and 42 exposed to the surfaces of the magnetic body 50, respectively (S30). The external electrodes 81 and 82 may be formed by using a paste containing a metal having excellent electrical conductivity. For example, the first and second external electrodes 81 and 82 may be formed by using the conductive paste containing nickel (Ni), copper (Cu), tin (Sn), silver (Ag), or alloys thereof. In addition, a plating layer (not illustrated) may be further formed on the external electrodes 81 and 82. In this case, the plating layer may include at least one selected from the group consisting of nickel (Ni), copper (Cu), and tin (Sn). For example, a nickel (Ni) layer and a tin (Sn) layer may be sequentially formed as the plating layer.

A description of features overlapping those of the electronic component according to the previous exemplary embodiment will be omitted.

Experimental Example

Table 1 below shows results obtained by measuring anisotropic plating growth of the second coil pattern part 62 formed on the first coil pattern part 61 by electroplating while changing the thickness a of the outermost coil pattern portion of the first coil pattern part and the thickness b of the inner coil pattern portions thereof.

TABLE 1

| | Sample No. | a | b | a − b | a/b | Deviation of Final Thickness | Short-Circuit Rate |
|---|---|---|---|---|---|---|---|
| * | 1 | 50 μm | 10 μm | 40 μm | 5.0 | 60 μm | 30% |
| * | 2 | 50 μm | 20 μm | 30 μm | 2.5 | 47 μm | 13% |
| | 3 | 50 μm | 30 μm | 20 μm | 1.7 | 15 μm | 0% |
| | 4 | 50 μm | 40 μm | 10 μm | 1.3 | 10 μm | 0% |
| * | 5 | 50 μm | 50 μm | 0 μm | 1.0 | 25 μm | 10% |
| * | 6 | 50 μm | 60 μm | −10 μm | 0.8 | 38 μm | 17% |
| * | 7 | 50 μm | 70 μm | −20 μm | 0.7 | 58 μm | 35% |

(* Comparative Example)

As shown in Table 1, it can be seen that when the first coil pattern part 61 satisfies Equations (1) and (2), the final thickness d of the coil pattern formed by anisotropic plating growth may be unexpectedly uniform.

Therefore, short-circuits occurring between the coil pattern portions may be unexpectedly prevented, the internal coil structures 41 and 42 may have a high aspect ratio (AR), and a volume of the core part 55 may be increased while decreasing direct current resistance Rdc, whereby high inductance may be obtained.

As set forth above, according to exemplary embodiments in the present disclosure, the thickness of a first coil pattern part may be controlled to induce anisotropic plating growth of a secondary coil pattern part, thereby providing a miniaturized electronic component having improved electrical properties, and a method of effectively manufacturing the electronic component.

While exemplary embodiments have been shown and described above, it will be apparent to those skilled in the art that modifications and variations could be made without departing from the scope of the present disclosure as defined by the appended claims.

What is claimed is:

1. An electronic component comprising:

a magnetic body; and an internal coil structure embedded in the magnetic body, wherein the internal coil structure includes a first coil pattern part and a second coil pattern part formed on the first coil pattern part, and an entire outermost coil turn of the first coil pattern part is thicker than an inner coil turn thereof, wherein the second coil pattern part has a non-uniform thickness such that a thickness from an uppermost surface of the outermost coil turn of the first coil pattern part to an uppermost surface of an outermost coil turn of the second coil pattern part is smaller than a thickness from an uppermost surface of the inner coil turn of the first coil pattern part to an uppermost surface of an inner coil turn of the second coil pattern part.

2. The electronic component of claim 1, wherein $0\ \mu m<a-b\leq 20\ \mu m$ is satisfied, in which a is a thickness of the outermost coil turn of the first coil pattern part and b is a thickness of the inner coil turn thereof.

3. The electronic component of claim 1, wherein $1<a/b\leq 1.8$ is satisfied, in which a is a thickness of the outermost coil turn of the first coil pattern part and b is a thickness of the inner coil turn thereof.

4. The electronic component of claim 1, wherein a difference between a sum of a thickness of the outermost coil turn of the first coil pattern part and a thickness of an outermost coil turn of the second coil pattern part formed thereon and a sum of a thickness of the inner coil turn of the first coil pattern part and a thickness of an inner coil turn of the second coil pattern part formed thereon is within 20 μm.

5. The electronic component of claim 1, wherein the second coil pattern part is formed by anisotropic plating.

6. The electronic component of claim 1, wherein the second coil pattern part is formed on upper surfaces of the coil turns of the first coil pattern part.

7. The electronic component of claim 1, wherein the second coil pattern part is not formed on at least a portion of side surfaces of the coil turns of the first coil pattern part.

8. The electronic component of claim 1, wherein the first and second coil pattern parts are formed of the same metal.

9. The electronic component of claim 1, wherein the magnetic body contains a magnetic metal powder and a thermosetting resin.

10. The electronic component of claim 1, wherein the internal coil structure comprises:

a first internal coil structure disposed on one surface of a support member; and a second internal coil structure disposed on another surface of the support member opposing the one surface thereof.

11. The electronic component of claim 10, wherein the support member has a through-hole in a central portion thereof, and the through-hole is filled with a magnetic material to form a core part.

12. The electronic component of claim 1, further comprising external electrodes disposed on outer surfaces of the magnetic body to be electrically connected to the internal coil structure.

13. The electronic component of claim 1, wherein a total thickness of an outermost coil turn of the first and second coil pattern parts is substantially the same as a total thickness of an inner coil turn of the first and second coil pattern parts.

14. A method of manufacturing an electronic component, the method comprising:

forming a first coil pattern part on a support member;

forming a second coil pattern part on the first coil pattern part so as to form an internal coil structure including the first and second coil pattern parts; and forming a magnetic body by stacking magnetic sheets to embed the internal coil structure therein, wherein the forming the first coil pattern part comprises forming the first coil pattern part such that an entire outermost coil turn of the first coil pattern part is thicker than an inner coil turn thereof, and the forming the second coil pattern part comprises forming the second coil pattern part to have a non-uniform thickness such that a thickness from an uppermost surface of the outermost coil turn of the first coil pattern part to an uppermost surface of an outermost coil turn of the second coil pattern part is smaller than a thickness from an uppermost surface of the inner coil turn of the first coil pattern part to an uppermost surface of an inner coil turn of the second coil pattern part.

15. The method of claim 14, further comprising forming external electrodes on outer surfaces of the magnetic body to be electrically connected to the internal coil structure.

16. The method of claim 14, wherein the second coil pattern part is formed by anisotropic plating.

17. An electronic component, comprising:

a magnetic body; and an internal coil structure embedded in the magnetic body, wherein the internal coil structure includes a first coil pattern part having a coil shape, and a second coil pattern part having a coil shape formed entirely and directly on the coil shaped first coil pattern part, and the first coil pattern part includes a plurality of inner coil turns having substantially same thicknesses, and an outermost coil turn an entirety of which is thicker than the plurality of inner coil turns.

18. The electronic component of claim 17, wherein $0\ \mu m<a-b\leq 20\ \mu m$ is satisfied, in which a is a thickness of the outermost coil turn of the first coil pattern part and b is a thickness of the inner coil turn thereof.

19. The electronic component of claim 17, wherein $1<a/b\leq 1.8$ is satisfied, in which a is a thickness of the outermost coil turn of the first coil pattern part and b is a thickness of the inner coil turn thereof.

20. The electronic component of claim 17, wherein a difference between a sum of a thickness of the outermost coil turn of the first coil pattern part and a thickness of an outermost coil turn of the second coil pattern part formed thereon and a sum of a thickness of the inner coil turn of the first coil pattern part and a thickness of an inner coil turn of the second coil pattern part formed thereon is within 20 μm.

* * * * *